United States Patent [19]

Tsukioka

[11] Patent Number: 4,699,072

[45] Date of Patent: Oct. 13, 1987

[54] SEWING MACHINE PRESSER FOOT MECHANISM

[75] Inventor: Takashi Tsukioka, Chofu, Japan

[73] Assignee: Tokyo Juki Industrial Co., Ltd., Chofu, Japan

[21] Appl. No.: 869,677

[22] Filed: Jun. 2, 1986

Related U.S. Application Data

[63] Continuation-in-part of Ser. No. 769,378, Aug. 26, 1985, abandoned.

[30] Foreign Application Priority Data

Aug. 28, 1984 [JP] Japan ..... 59-179067

[51] Int. Cl.[4] ..... D05B 29/00

[52] U.S. Cl. ..... 112/235

[58] Field of Search ..... 112/235, 311, 320, 236, 112/237

[56] References Cited

U.S. PATENT DOCUMENTS

| | | | |
|---|---|---|---|
| 3,952,675 | 4/1976 | Thompson | 112/320 |
| 4,058,071 | 11/1977 | Dunn et al. | 112/235 |
| 4,381,722 | 5/1983 | Takeuchi et al. | 112/235 |
| 4,452,158 | 6/1984 | De Palma et al. | 112/235 |

*Primary Examiner*—Werner H. Schroeder
*Assistant Examiner*—Andrew M. Falik
*Attorney, Agent, or Firm*—Morgan & Finnegan

[57] ABSTRACT

A presser foot control for a sewing machine comprises a solenoid and two springs having different spring constants arranged in series with a transmitting lever and a starting lever. A first weaker spring is set in a "previously-pulled" condition and is connected in series with a second, stronger spring. The solenoid force first pulls on the stronger, unloaded spring. Thereafter, the weaker spring, which has been pulled previously into a loaded condition, is pulled and presses the presser foot causing the workpiece to be pressed against the table. Despite variations of thickness in a workpiece, the invention is effective to clamp the workpiece with a substantially constant pressure value.

3 Claims, 11 Drawing Figures

SEWING MACHINE PRESSER FOOT MECHANISM

BACKGROUND OF INVENTION

This application is a continuation-in-part of U.S. Ser. No. 769,378, filed Aug. 26, 1985, abandoned.

The invention pertains to sewing machines. More particularly, the invention pertains to a presser foot control mechanism for a sewing machine.

Mechanisms of presser foot control for sewing machines are known to those conversant in the sewing art. Conventionally, a presser foot control mechanism comprises a foot which touches a workpiece, a spring which presses against the foot, and a solenoid member which presses against the spring causing the foot to press down the workpiece against a work table.

In such a conventional presser foot apparatus, a strong spring is required to press down the workpiece securely to protect the workpiece from slipping. Further, in such conventional presser foot control mechanisms, the spring generally presses the foot and a solenoid member directly presses the spring. Thus, in conventional systems, the spring force is necessarily varied by the thickness of the workpiece. In some cases, the spring force and the solenoid force are not well-balanced and consequently the proper presser foot function is not performed.

For example, as will be discussed below by way of reference to FIG. 6, when the workpiece is very thick, the spring force in conventional systems becomes increased and the solenoid cannot overcome the spring force.

It is therefore an object of the invention is to provide a presser foot control mechanism which eliminates the aforementioned demerits of conventional presser foot control mechanisms.

It is a further object of the invention to provide a presser foot control apparatus in which the spring force and the solenoid force remain well-balanced.

It is a still further object of the invention to provide a presser foot control mechanism which is effective for securely retaining a workpiece.

SUMMARY OF THE INVENTION

These and other objects of the invention are met by providing a presser foot control mechanism for a sewing machine wherein a solenoid force is transmitted to the presser foot through two springs having different forces which are arranged in series. The stronger spring, which is not previously loaded, is first pulled by the solenoid force. Thereafter, the weaker spring, which has been pulled previously into a loaded condition, is further pulled and pulls a clamp lever which presses the presser foot causing the workpiece to be pressed against the table with a substantially constant force. Intermediate linkages and levers are effective to transfer lifting and clamping forces.

BRIEF DESCRIPTION OF THE DRAWINGS

The invention will be described in greater detail below by way of reference to the following drawings, in which.

DETAILED DESCRIPTION OF THE DRAWINGS

Figure 1:
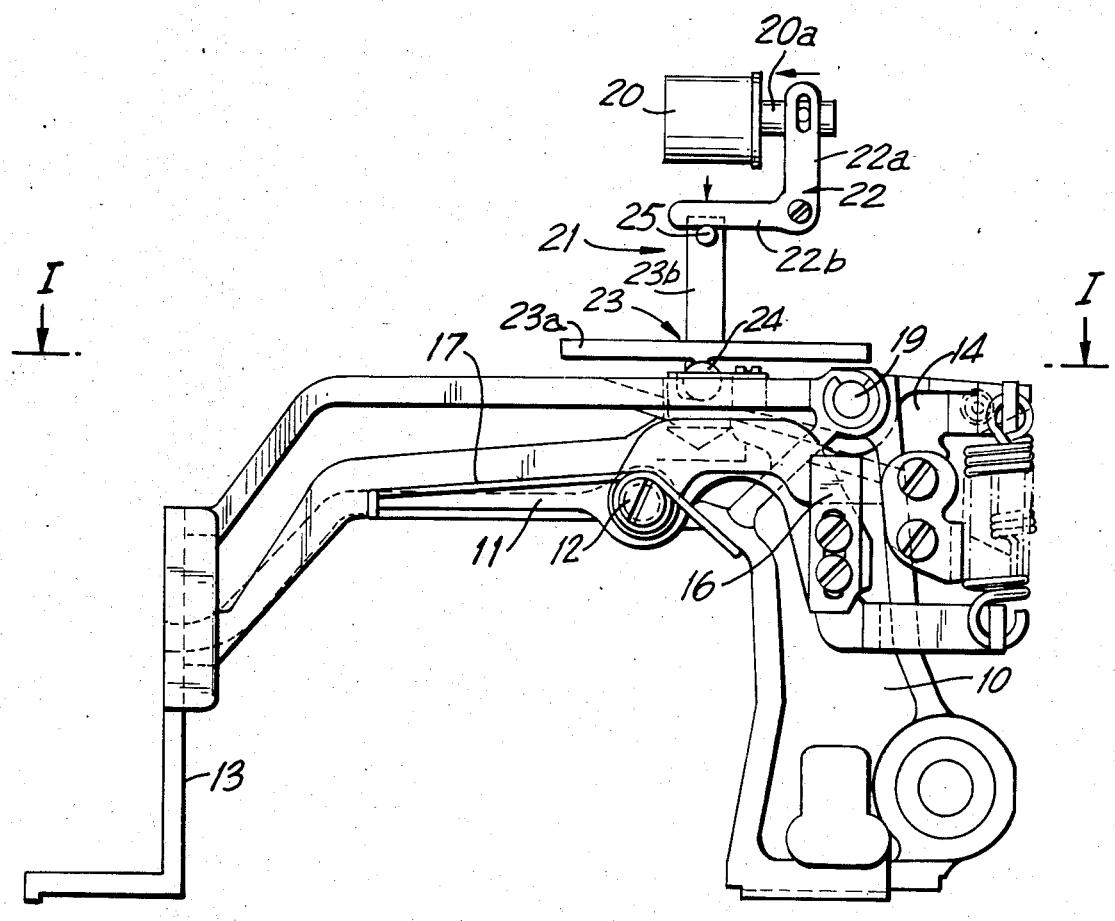
FIG. 1 is a side elevation of a sewing machine presser foot control apparatus according to the invention.

Refering to FIGS. 1–4 and 7–8 numeral 10 denotes a feed bracket. The feed bracket 10 is fixed to a sewing machine which is not illustrated in drawings.

A work clamp lever 11 is provided along the feed bracket 10. This work clamp lever consists of two lateral panel members 11*a* and 11*b*. The middle section of these two panel members 11*a*, 11*b* are sustained rotatably by a support shaft 12 which passes through the feed bracket 10.

A work clamp presser foot 13 is provided at the ends of panel members 11*a*, 11*b*. The work clamp presser foot 13 acts to press down a workpiece (not shown).

Figure 3:
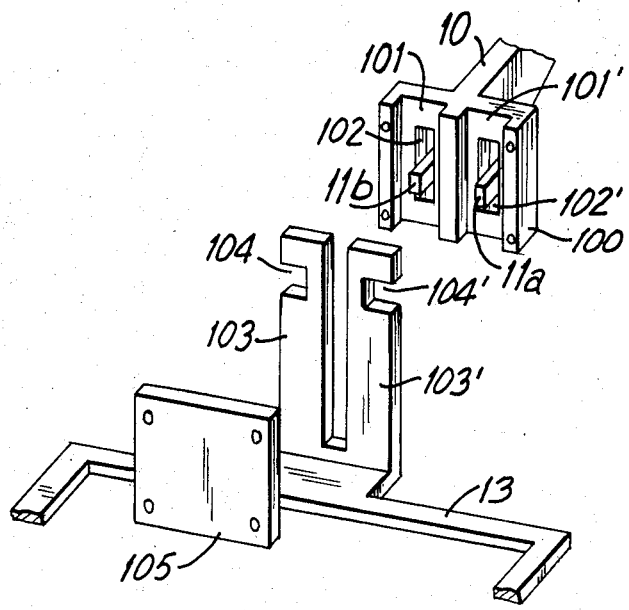
FIG. 3 is a perspective view illustrating details of a presser foot mechanism.

Refering to FIG. 3, a clamp frame 100 is fixed to the end of feed bracket 10. In this clamp frame 100, two grooves 101, 101' are provided and extend vertically along the clamp frame 100.

Tip portions of the plate members 11*a*, 11*b* protrude through slits 102 and 102' which are penetrating through the bottom of the clamp frame 100.

In the work clamp 13, two standing plates 103 and 103' (FIG. 3) are provided at its base body side. Each standing plate 103, 103' provides notches 104, 104', respectively, in which the tips of the lateral panels 11*a* and 11*b* are inserted. The standing plates 103 and 103' are inserted slidably in the grooves 101, 101' and the tips of the panel members 11*a* and 11*b* are inserted into notches 104, 104'. A cover 105 may then be screwed or otherwise fastened to the clamp frame 100 closing the grooves 101 and 101'.

Figure 7:
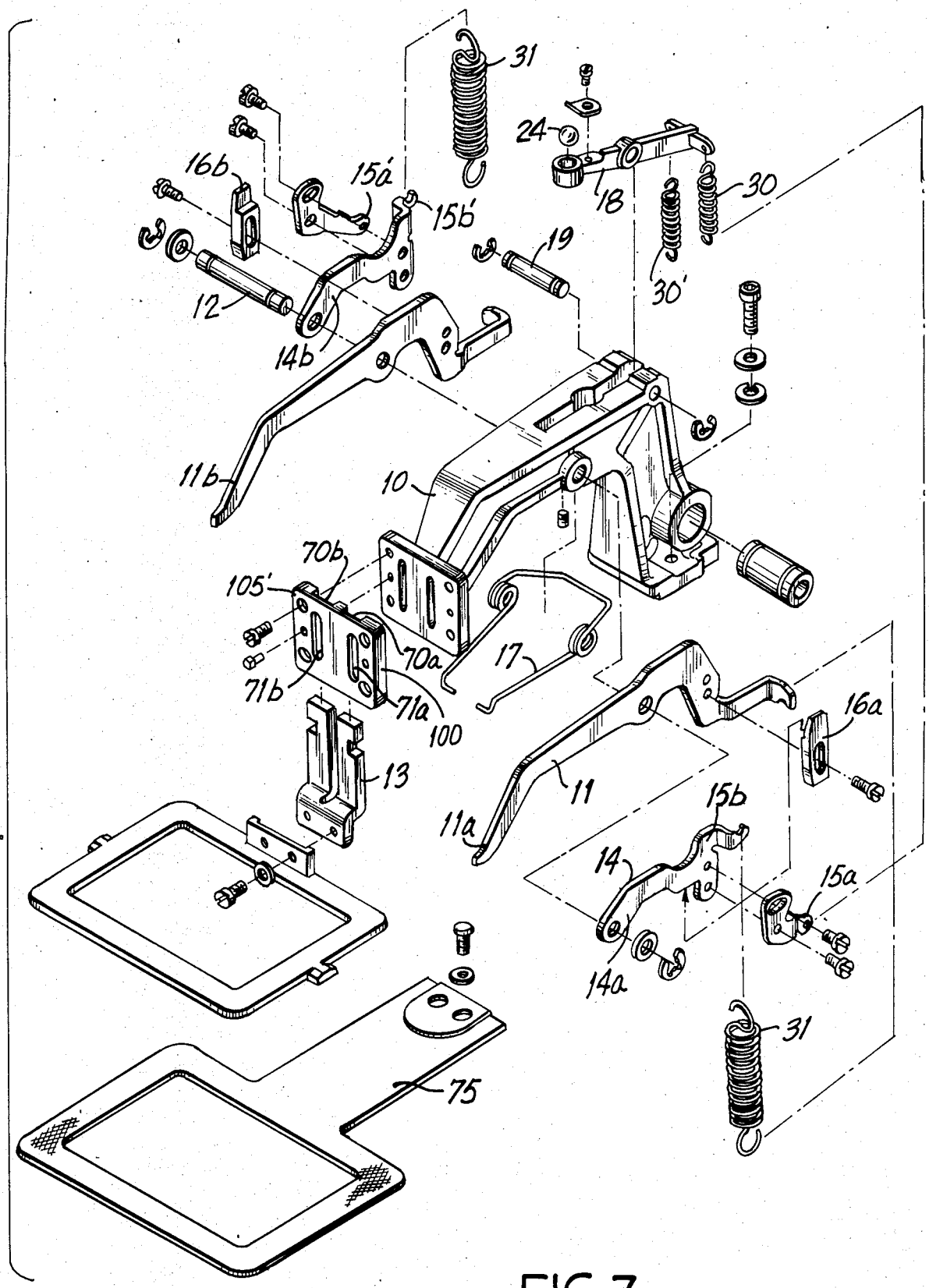
FIG. 7 is an exploded perspective view of a further embodiment of the invention.

Alternatively, as shown in FIG. 7, the retaining grooves 70*a*, 70*b* may be provided within the cover 105', which may further include slits 71*a*, 71*b*. *The embodiment of FIG. 7 functions as does the embodiment of FIG. 1, differing therefrom essentially only in the configuration of the cover 105' and the clamp frame 100. FIG. 7 additionally illustrates a feed plate 75.*

A transmitting lever 14 (FIGS. 1, 7) is also provided along side the feed bracket 10. This lever 14 consists of two panel parts 14*a* and 14*b* (see also FIG. 2) which are placed at opposite sides of feed bracket 10, respectively. The ends of the panel members 14*a*, 14*b* are sustained rotatably by the support shaft 12 which is further supporting the work clamp lever 11. At the other end of the panel members 14*a*, 14*b*, inside arms 15*a*, 15*a'* and outside arms 15*b*, 15*b'* are located.

Figure 2:
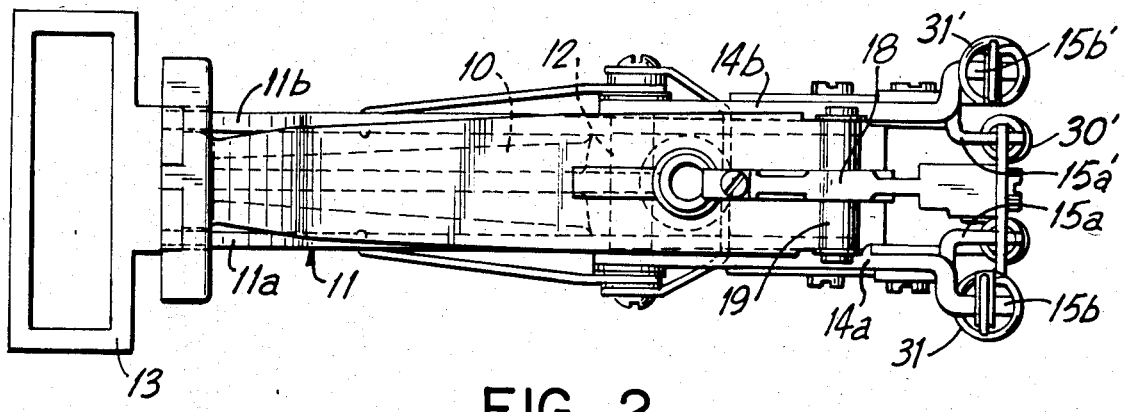
FIG. 2 is a plan view of the embodiment of FIG. 1 taken along the line I—I of FIG. 1.

Panel members 14*a*, 14*b* are inserted slidably in the space surrounded by the panels 11*a*, 11*b* and the stopper plate 16. Stopper plate 16 (FIG. 7) consists of two panels 16*a*, 16*b* (FIG. 2). By these panels 16*a*, 16*b*, the weak spring (second spring) 31 is set in the "previously-pulled" condition.

Referring to FIGS. 1, 2 and 7, numeral 17 denotes a resilient spring which is sustained by the support shaft 12 and urges the work clamp lever 11 to be lifted from the workpiece.

A starting lever 18 is also provided atop the feed bracket 10. The middle part of this starting lever 18 is sustained rotably by a shaft 19 transverse through feed bracket 10. The starting lever 18 is acted upon by a solenoid member 20 through linkage 21. This linkage 21 consists of a lever 22 which is sustained at the sewing machine body (not shown) and a pressing plate 23 which is positioned between the end of the starting lever 18 and the lever 22. One end of the arm 22*a* is linked to the outer end of the solenoid core 20*a*.

Pressing plate 23 consists of a horizontal portion 23*a* and a vertical portion 23*b*. The horizontal portion 23*a* contacts a ball 24. At the upper end of vertical portion 23*b*, a pin 25 is provided. Arm 22*b* of the lever 22 and the pin 25 are contacting. Thus, if the solenoid member 20 is actuated and its core 20*a* is moved in the direction of the arrow in FIG. 1, the lever 22 rotates counter-clockwise.

Figure 8:
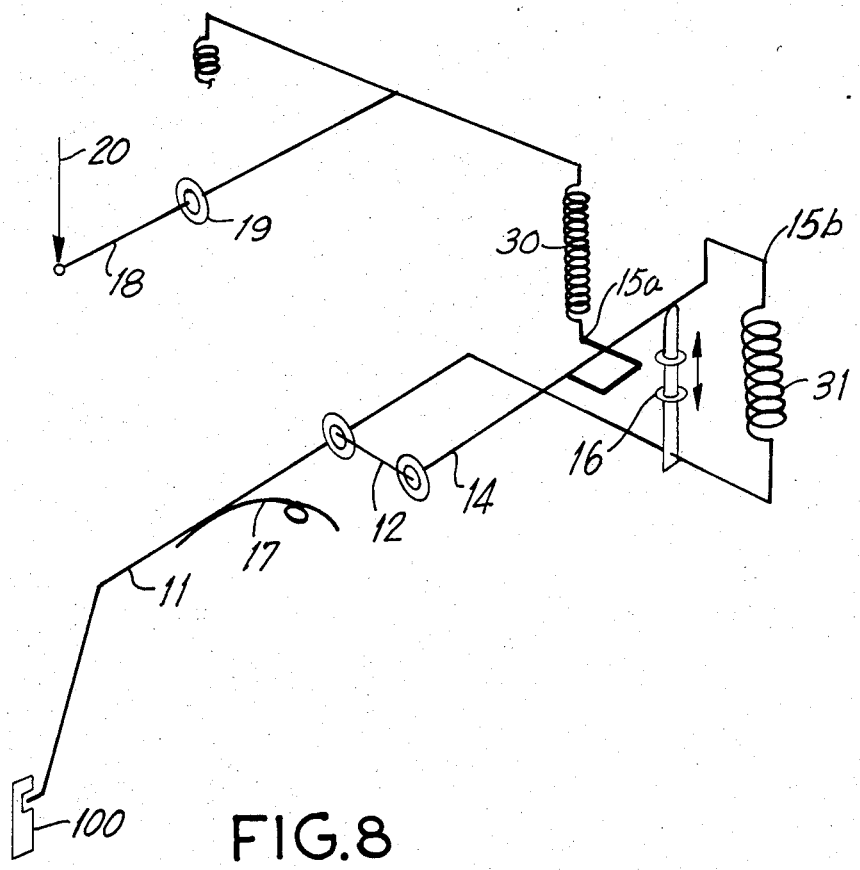
FIG. 8 is a schematic perspective illustration of the embodiment of FIG. 1 illustrating the mechanical function thereof.

Between the starting lever 18 and the transmitting lever 14, the first spiral springs 30, 30' are provided (see FIGS. 3, 7–8). One end of the first spiral springs 30, 30' are connected to the end of the starting lever 18 while the other end of the first spiral springs 30, 30' are connected to the inner arm 15*a*, 15*a'* of the transmitting lever 14. Between the transmitting lever 14 and the work clamp lever 11, the second spiral springs 31, 31' are provided. One end of the second spiral springs 31, 31' are connected to outer arms 15*b*, 15*b'* of the transmitting lever 14 while the other end of the spiral springs 31, 31' are connected to the end of work clamp lever 11 which is located at the opposite side of the work clamp foot 13.

In this mechanism according to the invention, the force of the first spiral spring 30, 30' is stronger than the force of the second spiral spring 31, 31', and the second spring is set in the "previously-pulled" contition. This means that the spring constant of the first spiral spring is larger than the spring constant of the second spiral spring.

The performance of the aforementioned presser foot apparatus will now be explained.

Referring to FIG. 1, the solenoid 20 is actuated and the core 20*a* is moved to the direction of the arrow. Through linkage 21, which applies a downwards force on the forward end of starting lever 18, the starting lever 18 tends to rotate counter-clockwise about shaft 19 and the first (strong) spiral springs 30, 30' (FIGS. 2–4, 7–9) are pulled.

Figure 4:
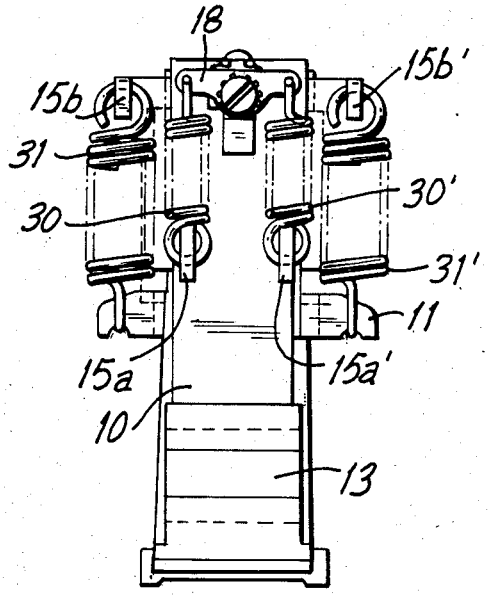
FIG. 4 is a partial front view of the embodiment of FIG. 1.

As shown in FIG. 4, the lower ends of strong springs 30, 30' are connected to panel arm members 15*a*, 15*a'*. *Panel members 15a,* 15*a'* are secured to lever 14. Thus, as the strong springs 30, 30' pull panel arms 15*a*, 15*a'*, *the transmitting lever 14 is rotated counter-clockwise by the restoring force of the first spiral spring 30, 30'. In other words, as spring 30 is pulled at one end, the other end of the spring 30 pulls panel arms 15, 15a'* which in turn pull transmitting lever 14, rotating transmitting lever 14 counter-clockwise. This action of the spring 30 and transmitting lever 14 likewise causes the inner arms 15*a*, 15*a'* to move upward. Through this action, the outer arms 15*b*, 15*b'* are also moved upward and pull the second spiral spring 31, 31' since the outer arms and inner arms are united within one body.

This upward action of the outer arm 15*b*, 15*b'* causes the weak springs 31, 31' to be pulled which in turn causes the end of the work clamp lever 11 opposite presser foot 13 to move upward. The one side of the work clamp lever 11 is pulled by spring 31 upward and accordingly, the opposite side of the work clamp lever 11 moves downward causing the lever end 11*a* to press clamp frame 100 (see FIG. 3). The work clamp lever 11 thus rotates counter-clockwise and the work clamp 13 presses down the workpiece on the table.

When solenoid 20 is de-energized, the first spiral spring 30, 30' and the second spiral spring 31, 31' restore the original positions of the mechanism as the work clamp lever 11 is rotated clockwise by resilient spring 17 (see FIGS. 1, 8). The presser foot 13 thus releases the workpiece.

FIG. 8 is perspective schematic view of the embodiments of FIGS. 1 and 7 illustrating the mechanical properties thereof. As FIG. 8 illustrates, the solenoid 20 acts in the direction of the arrow, starting lever 18 rotating counter clockwise keeping shaft 19 as its center. The end of lever 18 opposite solenoid 20 thereby pulls spring 30 upward pulling lever panel arm 15*a*. Transmitting lever 14, which is secured to arm 15*a*, is thereby also pulled and accordingly rotates counter-clockwise keeping shaft 12 as its center. Outside arm 15*b* thus moves upward pulling spring 31 upward. Work clamp lever 11 thus rotates counter-clockwise keeping the shaft 12 as the center. As a result, clamp frame 100 goes down.

Figure 9:
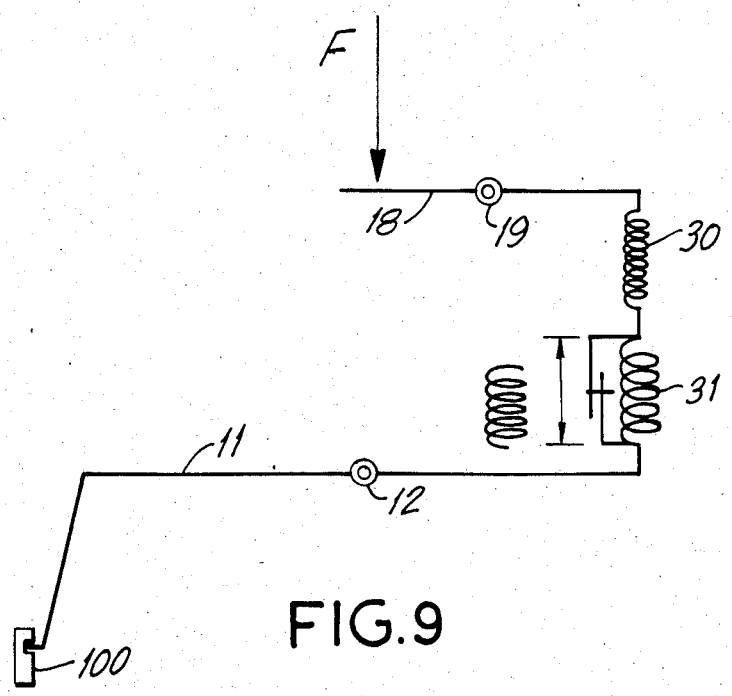
FIG. 9 is a further schematic illustration of an embodiment of the invention.

FIG. 9 further illustrates the series connection of the strong spring 30 and the previously pulled weak spring 31. As shown in FIG. 9, the solenoid force F is applied to the starting lever 18. The application of solenoid force F to the starting lever 18 causes the starting lever 18 to rotate counterclockwise about shaft 19, pulling the strong spring 30. The pulling of spring 30 in turn pulls weak spring 31 which is already in a previously pulled condition. Weak spring 31 is thereby lifted and this lifting motion is transferred to work clamp lever 11. Work clamp lever 11 thereby rotates counterclockwise about shaft 12. The counterclockwise rotation of work clamp lever 11 causes clamp frame 100 to be pressed downward.

Figure 5A:
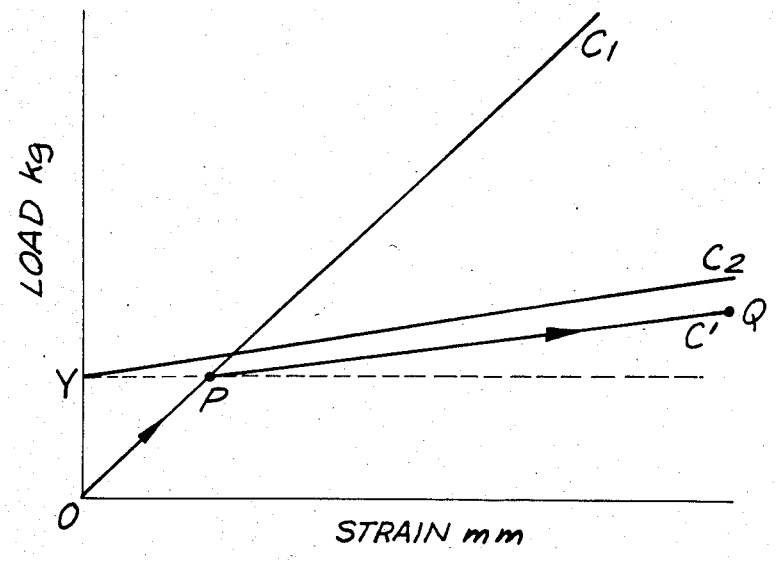
FIGS. 5A–5C are graphical representations of spring characteristics and solenoid force applied in an apparatus according to the present invention.

The effect of the series connection of the strong and the weak springs according to the invention will now be described by way of reference to FIGS. 5A–5C. FIG. 5A illustrates the spring characteristics of a strong spring $C_1$ and a weak spring $C_2$. The characteristic of the weak spring $C_2$ is shown in a previously pulled condition, pulled at a load of Y kg. Thus, the spring characteristic $C_2$ of the weaker spring intercepts the ordinate at Y kg. Although specific spring characteristics are shown in FIG. 5A, these characteristics are, of course, only representative and should not be deemed to limit the invention.

In acordance with the invention, the two springs are connected in series, and thereby a resultant spring constant C' is achieved in accordance with the following well-known formula:

$$\frac{1}{C'} = \frac{1}{C_1} + \frac{1}{C_2}$$

With a strong spring and a weak (previously pulled) spring in a series combination according to the invention, if a load is applied, at first the strong spring expands along the line OP as the arrow in FIG. 5A shows. At the point P (i.e. at a load equal to the previously pulled load of Y kg), both the weak spring and the strong spring expand, and the effective in series spring expands along the line PQ. Thus, according to the invention, the seriesed spring expands along a line such as O–P–Q in FIG. 5A.

Figure 5B:
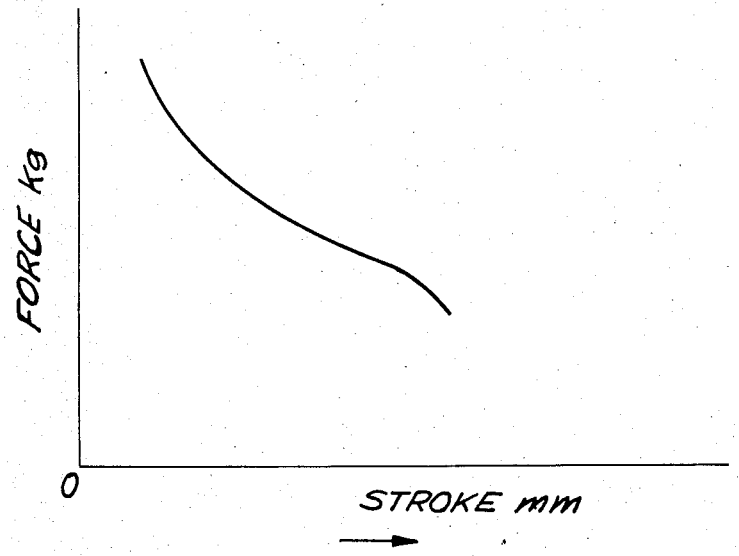

FIG. 5B illustrates a representative characteristic curve of a solenoid 20 of the type shown in FIG. 1. Such curves are routinely ascertained by empirical measurement and show the force exerted by a solenoid versus the stroke distance of the mover. The solenoid characteristic curve of FIG. 5B may be reverse plotted to show the same curve in terms of force versus stroke where the stroke is measured from a baseline forward of the solenoid. Such a reverse plotted solenoid characteristic curve is shown in FIG. 5C.

Figure 5C:
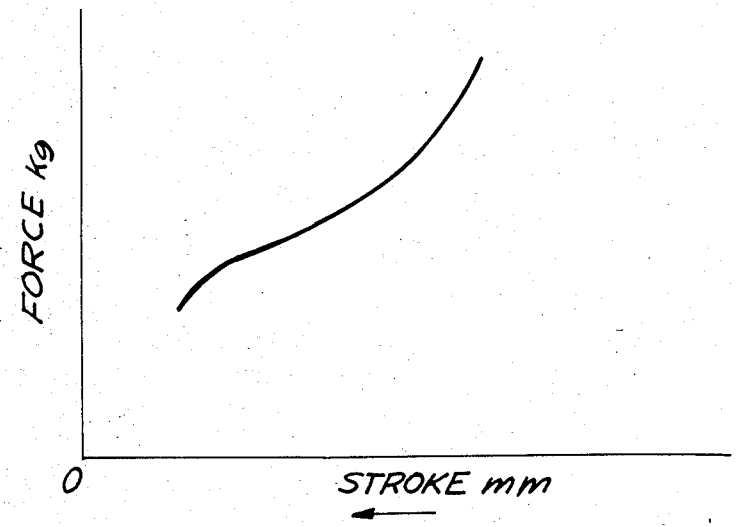

By comparing the reverse plotted curve of FIG. 5C with the line O–P–Q of FIG. 5A, it is apparent that both the solenoid characteristic curve of FIG. 5C and the seriesed spring characteristic line O–P–Q of FIG. 5A have an essentially similar tendency, i.e. they are roughly parallel.

Figure 6:
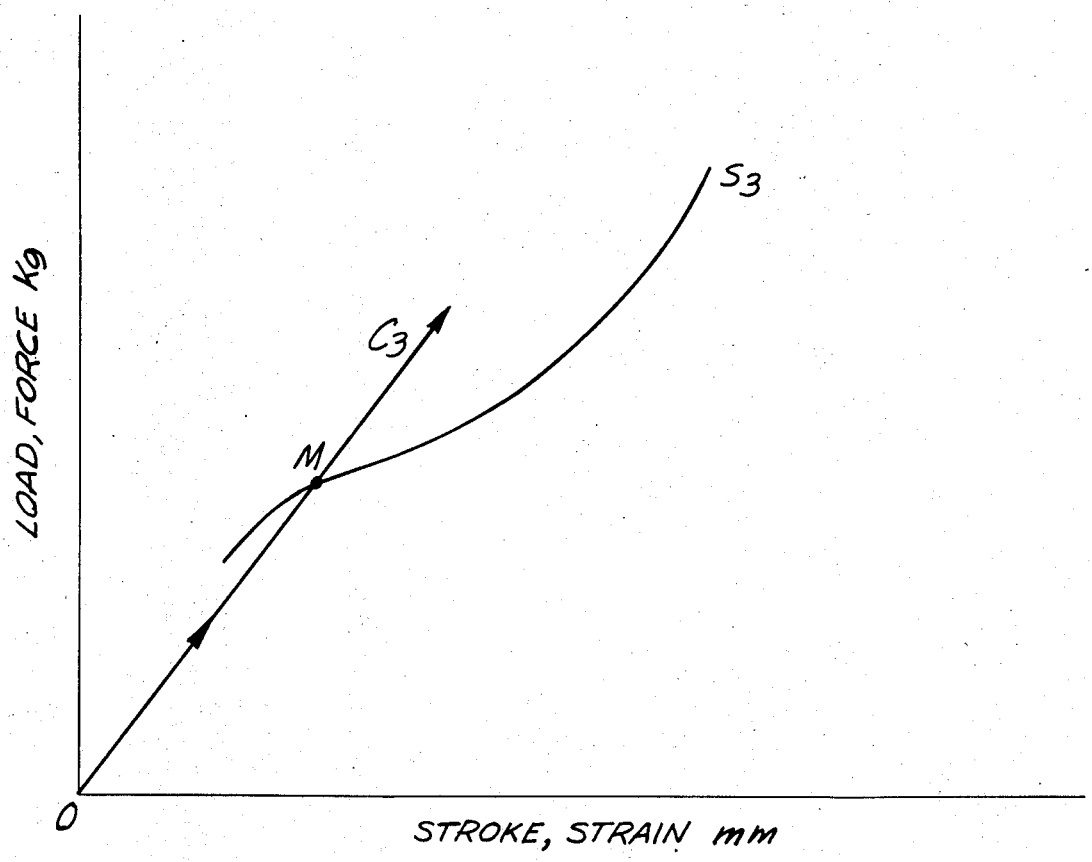
PRIOR ART FIG.6
FIG. 6 is a graphical representation of spring characteristics and solenoid force applied in a conventional presser foot control mechanism.

FIG. 6 illustrates spring $C_3$ and solenoid $S_3$ characteristic lines of a configuration such as practiced by the prior art. In such embodiments, where only a single spring is provided, the spring strain characteristic line would expand along a line such as $C_3$ in FIG. 6. After the spring strain line $C_3$ crosses the solenoid characteristic curve $S_3$ at point M, the solenoid force cannot meet with the required spring load. However, in embodiments of the invention, the solenoid force and the spring force are well balanced throughout the length of the solenoid stroke (compare FIGS. 5A and 5C), and although a thick workpiece may be clamped between the presser foot and the throat plate, a relatively weak force is sufficient to clamp the thick workpiece.

According to the invention, a strong first spiral spring 30, which is not loaded, and a weak second spiral spring which is set in a "previously-pulled" condition, are arranged in series and a solenoid force is transmitted to the presser foot lever through the two springs in series. This arrangement is effective to balance the solenoid force and the spring force to provide uniform foot pressure despite variations in solenoid requirements due to thick workpiece conditions. Thus, when the workpiece is very thick, the force of the two combined springs meet with the load-strike characteristics of the solenoid force.

Accordingly, when the workpiece is thick, the two springs are used at a higher load while the pressure of the presser foot is kept substantially uniform.

As many apparently widely different embodiments of the invention may be made without departing from the spirit and scope therein, it is to be understood that invention is not limited to the specific embodiments disclosed herein except as defined in the appended claims.

I claim:

1. A presser foot control apparatus for a sewing machine, comprising: a work clamp lever with a center portion sustained rotatably at a feed bracket, a presser foot attached to one end of the work clamp lever, a trasmitting lever with one end sustained rotatably at the feed bracket, a starting lever with a center portion sustained rotatably at the feed bracket, a first spring connecting the end of the said starting lever and the free end of said transmitting lever, and a second spring connecting the other end of the said work clamp lever and the free end of the said transmitting lever.

2. A presser foot apparatus as recited in claim 1, in which the spring constant of the first spring is larger than the spring constant of the second spring.

3. A presser foot apparatus, as recited in claim 2, wherein the second spring is set in a previously pulled condition.

* * * * *